United States Patent [19]

Blaser

[11] 4,297,202

[45] Oct. 27, 1981

[54] TWO-STAGE INTEGRATED COKING FOR CHEMICALS AND COKE GASIFICATION PROCESS

[75] Inventor: Don E. Blaser, Randolph, N.J.

[73] Assignee: Exxon Research & Engineering Co., Florham Park, N.J.

[21] Appl. No.: 922,044

[22] Filed: Jul. 5, 1978

Related U.S. Application Data

[63] Continuation-in-part of Ser. No. 789,569, Apr. 21, 1977, abandoned.

[51] Int. Cl.[3] ..... C10G 9/28; C10G 37/06

[52] U.S. Cl. ..... 208/54; 208/127

[58] Field of Search ..... 208/127, 164, 54; 48/197 R

[56] References Cited

U.S. PATENT DOCUMENTS

| | | | |
|---|---|---|---|
| 2,763,601 | 9/1956 | Martin et al. | 208/48 Q |
| 2,859,168 | 11/1958 | Downing et al. | 208/48 R |
| 3,816,084 | 6/1974 | Moser et al. | 208/127 |

*Primary Examiner*—O. R. Vertiz
*Assistant Examiner*—Wayne A. Langel
*Attorney, Agent, or Firm*—M. L. Gibbons

[57] ABSTRACT

Unsaturated light hydrocarbons are produced by coking a heavy hydrocarbonaceous oil in a conventional fluid coking zone and subsequently heating the vaporous coker product to a higher temperature in a gas-solids separation zone, such as the coking reactor's cyclone separator, with hot solids derived from a coke gasification zone.

10 Claims, 1 Drawing Figure

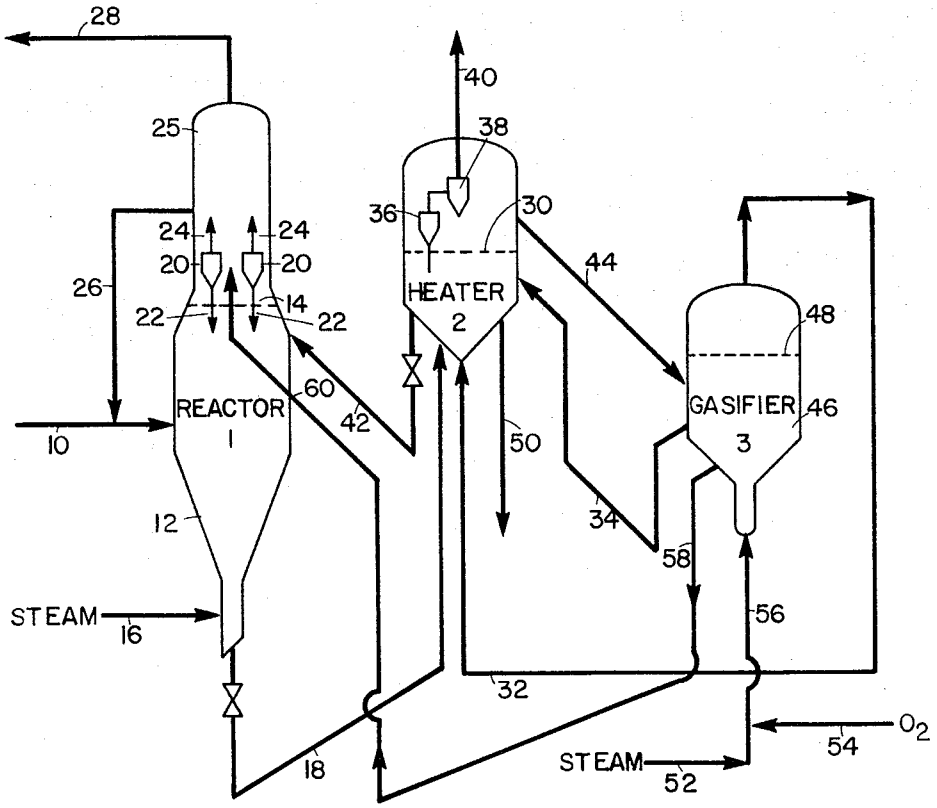
GASIFIER
3
HEATER
2
REACTOR
1
STEAM
STEAM
$O_2$
10
12
14
16
18
20
22
24
25
26
28
30
32
34
36
38
40
42
44
46
48
50
52
54
56
58
60

TWO-STAGE INTEGRATED COKING FOR CHEMICALS AND COKE GASIFICATION PROCESS

CROSS REFERENCE TO RELATED APPLICATIONS

This application is a continuation-in-part of U.S. application Ser. No. 789,569, filed Apr. 21, 1977, now abandoned, the teachings of which are hereby incorporated by specific reference.

BACKGROUND OF THE INVENTION

1. Field of the Invention

The present invention relates to an improvement in an integrated fluid coking and coke gasification process for the production of unsaturated light hydrocarbons and aromatics useful as chemicals and chemical intermediates.

2. Description of the Prior Art

The fluid coking process for the production of fuels, such as gas oil and naphtha is a well known process and is disclosed in U.S. Pat. No. 2,881,130, the teachings of which are hereby incorporated by reference. Integrated fluid coking and coke gasification processes are also known and disclosed, for example, in U.S. Pat. Nos. 3,661,543 and 3,816,084, the teachings of which are hereby incorporated by reference.

Fluid coking processes for the production of chemicals and chemical intermediates are also known. See, for example, U.S. Pat. No. 2,846,360 and U.S. Pat. No. 2,871,183. Generally, when it is desired to produce chemicals rather than fuel oils, heretofore, the fluid coking process usually included a high temperature transferline coking zone and a fluidized bed coking zone.

It is also known to introduce a small amount of hot solids into a gas-solids separation zone, such as the cyclone separator, used to separate entrained solids from the vaporous coker product so as to prevent coke deposition on the walls of the cyclone separator. See, for example, U.S. Pat. Nos. 2,763,601; 2,859,168 and 2,943,993.

It has now been found that coking for the production of chemicals and chemical intermediates can be performed by coking a carbonaceous material in a conventional fluid coking zone and subsequently heating the resulting vaporous product to a temperature sufficient to crack the coker vaporous product to unsaturated hydrocarbons in a conventional gas-solids separation zone used to remove entrained solids from the coker vaporous product. The heat in the gas-solids separation zone is provided by passing a portion of hot solids from a gasification zone to the gas-solids separation zone.

SUMMARY OF THE INVENTION

In accordance with the invention there is provided in an integrated coking and gasification process comprising the steps of (a) reacting a carbonaceous material having a Conradson carbon content of at least 10 weight percent in a coking zone containing a bed of fluidized solids maintained at fluid coking conditions, including a temperature ranging from about 850° to about 1195° F., to form a vaporous coking zone conversion product and coke, said coke depositing on said fluidized solids; (b) introducing at least a portion of said solids with the coke deposition thereon into a heating zone operated at a temperature greater than said coking zone temperature to heat said portion of solids; (c) recycling a first portion of heated solids from said heating zone to said coking zone and introducing a second portion of said heated solids to a fluid bed gasification zone maintained at a temperature greater than the temperature of said heating zone; (d) passing said vaporous coker conversion product with entrained solids to a gas-solids separation zone, the improvement which comprises: withdrawing a portion of solids from said gasification zone and introducing said portion of solids into said gas-solids separation zone in an amount sufficient to maintain said gas-solids separation zone at a temperature in the range of about 1200 to about 1700 degrees Fahrenheit to convert at least 20 weight percent of said vaporous coking zone product to unsaturated hydrocarbons having less than 6 carbon atoms.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a carbonaceous material having a Conradson carbon residue of about 15 weight percent such as heavy residuum having a boiling point (at atmospheric pressure) of about 1050° F.+ is passed by line 10 into a coking zone 12 in which is maintained a fluidized bed of solids (e.g., coke particles of 40 to 1000 microns in size) having an upper level indicated at 14. Carbonaceous feeds suitable for the present invention include heavy hydrocarbonaceous oils; heavy and reduced petroleum crudes; petroleum atmospheric distillation bottoms; petroleum vacuum distillation bottoms; pitch, asphalt, bitumen, other heavy hydrocarbon residues; coal; coal slurry; liquid products derived from coal liquefaction processes and mixtures thereof. Typically such feeds have a Conradson carbon residue of at least 10 weight percent, generally from about 10 to about 50 weight percent (as to Conradson carbon residue, see ASTM test D-189-65). A fluidizing gas, e.g., steam, is admitted at the base of coking reactor 1 through line 16 in an amount sufficient to obtain superficial fluidizing gas velocity in the range of 0.5 to 5 feet per second. Coke at a temperature above the coking temperature, for example, the temperature from about 100 to about 400 Fahrenheit degrees in excess of the actual operating temperature of the coking zone is admitted to rector 1 by line 42 in an amount sufficient to maintain the coking temperature in the range of about 850° to about 1195° F., preferably at a temperature ranging from about 900° to about 1100° F., more preferably at a temperature ranging from about 950° to about 1050° F. The pressure in the coking zone is maintained in the range from about 5 to about 150 pounds per square inch gauge (psig), preferably in the range of about 5 to about 45 psig. The lower portion of the coking reactor serves as a stripping zone to remove occluded hydrocarbons from the coke. A stream of coke is withdrawn from the stripping zone by line 18 and circulated to heater 2. The vaporous coking zone conversion product is passed through a gas-solids separation zone such as cyclones 20 to remove entrained solids which are returned to the coker zone through dipleg 24. The cyclone separator system may be one or more cyclones. In accordance with the present invention, the temperature in the cyclone is maintained in the range of 1200 to 1700 degrees Fahrenheit, preferably at a temperature in the range of about 1300 to about 1500 degrees Fahrenheit, to convert at least a portion of the coking zone conversion product into unsaturated lower boiling hydrocarbons such as olefins and diolefins and into aromatics which are useful as chemicals or chemical intermediates. The temperature in the cyclones is maintained at an elevated temperature by introducing into the cyclones a sufficient amount of a stream of hot solids withdrawn from the gasifier by line 58 and then injected by line 60 above the dense fluid bed into the dilute phase in the region adjacent to the inlets of the cyclones. The heated gasifier solids may be discharged into the vaporous coker product passing into the cyclones via the inlets of the cyclones or the hot gasifier solids may be introduced directly into the cyclone separators. Preferably, the amount of hot gasifier solids introduced into the cyclones is such as to convert at least 20 weight percent of the coker vaporous product to unsaturated hydrocarbons having less than 6 carbon atoms. The resulting vapors leave the cyclones through line 24 and pass into a scrubber 25 mounted on the coking reactor. If desired, a stream of heavy material condensed in the scrubber may be recycled to the coking reactor via line 26. Furthermore, if desired a portion of the carbonaceous feed may be injected into the scrubber to provide an adequate volume to carry coke fines back to the coking zone. The cyclone conversion products are removed from scrubber 25 via line 28 for fractionation in a conventional manner. In heater 2, stripped coke from coking reactor 1 (commonly called cold coke) is introduced by line 18 to a fluid bed of hot coke having an upper level indicated at 30. The bed is partially heated by passing a fuel gas into the heater by line 32. Supplementary heat is applied to the heater by coke circulating in line 34. The gaseous effluent of the heater, including entrained solids, passes through a cyclone which may be a first cyclone 36 and a second cyclone 38 wherein separation of the larger entrained solids occurs. The separated larger solids are returned to the heater bed via the respective cyclone diplegs. The heater gaseous effluent which still contains entrained solids fines is removed from heater 2 via line 40.

Hot coke is removed from the fluidized bed in heater 2 and recycled to coking reactor by line 42 to supply heat thereto. Another portion of coke is removed from heater 2 and passed by line 44 to a gasification zone 46 in gasifier 3 in which is maintained a bed of fluidized coke having a level indicated at 48. If desired, a purge stream of coke may be removed from heater 2 by line 50.

The gasification zone is maintained at a temperature ranging from about 1,500° to about 2,000° F., preferably at a temperature ranging from about 1600° to about 2000° F., more preferably at a temperature ranging from about 1700° to about 1900° F., and at a pressure ranging from about 5 to about 150 psig, preferably at a pressure ranging from about 10 to about 60 psig and more preferably at a pressure ranging from about 25 to about 45 psig. Steam by line 52 and an oxygen-containing gas such as air, commercial oxygen or air enriched with oxygen by line 54 are passed via line 56 into gasifier 3. Reaction of the coke particles in the gasification zone with the steam and the oxygen-containing gas produces a hydrogen and carbon monoxide-containing fuel gas. The gasifier product fuel gas, which may further contain some entrained solids, is removed overhead from gasifier 3 by line 32 and introduced into heater 2 to provide a portion of the required heat, as previously described.

While the process has been described for simplicity of description with respect to circulating coke as the fluidized medium, it is to be understood that the fluidized seed particles on which the coke is deposited may be silica, alumina, zirconia, magnesia, calcium oxide, alundum, mullite, bauxite or the like. The fluidized solids may or may not be catalytic in nature.

What is claimed is:

1. In an integrated coking and gasification process comprising the steps of:

(a) reacting a carbonaceous material having a Conradson carbon content of at least 10 weight percent in a coking zone containing a bed of fluidized solids maintained at fluid coking conditions including a temperature ranging from about 850° F. to about 1195° F., to form a vaporous coking zone conversion product and coke, said coke depositing on said fluidized solids;

(b) introducing a portion of said solids with the coke deposition thereon into a heating zone operated at a temperature greater than said coking zone temperature to heat said portion of solids;

(c) recycling a first portion of heated solids from said heating zone to said coking zone and introducing a second portion of said heated solids to a fluid bed gasification zone maintained at a temperature greater than the temperature of said heating zone, and (d) passing said vaporous coking zone conversion product with entrained solids to a gas-solids separation zone, the improvement which comprises withdrawing a portion of solids from the gasification zone and introducing said portion of solids into said gas-solids separation zone in an amount sufficient to maintain said gas-solids separation zone at a temperature in the range of about 1200 to about 1700 degrees Fahrenheit to convert at least 20 weight percent of the coking zone vaporous product to unsaturated hydrocarbons having less than 6 carbon atoms.

2. The process of claim 1 wherein said portion of gasification zone solids is introduced into said vaporous coking zone product passing into said gas-solids separation zone.

3. The process of claim 1 wherein said portion of gasification zone solids is introduced directly into said gas-solids separation zone.

4. The process of claim 1 wherein said coking zone is maintained at a temperature ranging from about 900° to about 1100° F.

5. The process of claim 1 wherein said gasification zone is maintained at a temperature ranging from about 1500° to about 2000° F.

6. The process of claim 1 wherein said gasification zone is maintained at a temperature ranging from about 1600° to about 2000° F.

7. The process of claim 1 wherein said coking zone and said gasification zone are each maintained at a pressure ranging from about 5 to about 150 psig.

8. In an integrated coking and gasification process comprising the steps of:

(a) reacting a carbonaceous material having a Conradson carbon content of at least 10 weight percent in a coking zone containing a bed of fluidized solids maintained at a temperature ranging from about 900° to about 1100° F. to form a vaporous coking zone product and coke, said coke depositing on said fluidized solids;

(b) introducing a portion of said solids with the coke deposition thereon into a heating zone operated at a temperature greater than said coking zone temperature to heat said portion of solids;

(c) recycling a first portion of heated solids from said heating zone to said coking zone;

(d) introducing a second portion of heated solids to a fluid bed gasification zone maintained at a temperature ranging from about 1500° to about 2000° F.;

(e) reacting said portion of heated solids in said gasification zone with steam and an oxygen-containing gas to produce a hot gaseous stream containing hydrogen and carbon monoxide;

(f) introducing said hot gaseous stream and entrained solids into said heating zone;

(g) passing an additional stream of solids from said gasification zone to said heating zone, and (h) passing said vaporous coking zone conversion product with entrained solids to a gas-solids separation zone, the improvement which comprises passing a portion of solids from said gasification zone to said gas-solids separation zone in an amount sufficient to maintain said gas-solids separation zone at a temperature in the range of about 1200 to about 1700 degrees Fahrenheit, to convert at least 20 weight percent of said vaporous coking zone product to unsaturated hydrocarbons having less than 6 carbon atoms.

9. The process of claim 8 wherein said gasification zone is maintained at a temperature ranging from about 1600° to about 2000° F.

10. The process of claim 8 wherein said portion of solids from said gasification zone is passed to said gas-solids separation zone in an amount sufficient to maintain said gas-solids separation zone at a temperature in the range of about 1300 to about 1500 degrees Fahrenheit.

* * * * *